US005676313A

United States Patent [19]

Wang

[11] Patent Number: 5,676,313

[45] Date of Patent: Oct. 14, 1997

[54] REGULATING CAP WITH PROTECTION COVERS

[75] Inventor: King-Yuan Wang, Changhua Hsien, Taiwan

[73] Assignee: Yuan Mei Corp., Taipei, Taiwan

[21] Appl. No.: 501,657

[22] Filed: Jul. 12, 1995

[51] Int. Cl.[6] ..... B05B 1/28; B05B 1/32

[52] U.S. Cl. ..... 239/288.5; 239/458; 239/460

[58] Field of Search ..... 239/288–288.5, 239/451, 456–458, 460, 537–539, 581.1, 581.2

[56] References Cited

U.S. PATENT DOCUMENTS 3,387,791 6/1968 Allenbaugh, Jr. ..... 239/458 X 3,863,844 2/1975 McMillan ..... 239/458 X

*Primary Examiner*—Lesley D. Morris

*Attorney, Agent, or Firm*—Beveridge, DeGrandi, Weilacher & Young, L.L.P.

[57] ABSTRACT

An improved water regulating cap mounted in combination to a sprinkler gun is provided with a soft guard cover at the front end thereof and a rubber friction cover at the rear end thereof so as to protect the regulating cap from damage in one aspect and to facilitate the operation thereof in another aspect. The soft guard cover and the rubber friction cover can also be integrally formed and removably mounted to the regulating cap readily.

2 Claims, 5 Drawing Sheets

REGULATING CAP WITH PROTECTION COVERS

BACKGROUND OF THE INVENTION

The present invention relates to an improved water regulating cap having protection covers secured thereto and mounted in combination to a sprinkler gun for use in gardening or car washing. The front section of the cap is provided with a soft cover made of rubber, and the rear section thereof is equipped with a rubber friction cover. The rubber friction cover having a plurality of parallel spaced protrusion blocks on the outer surface thereof and has a plurality of finely disposed ditches and a protruded circular flange section on the inner surface thereof. The regulating cap has an extension at the rear end thereof having a diameter equal to that of the protruded circular flange of the rubber friction cover. In connection to the extension is a first ring portion having a plurality of finely disposed ditches in correspondence to those of the rubber friction cover so that the rubber friction cover can firmly engage with the end of the regulating cap.

As shown in FIGS. 1, 2, a conventional water regulating cap 20 is mounted in combination to a sprinkler gun 10. The sprinkler gun 10 has a threaded section 11, a number of water outlet ports 12 and a regulating rod 13. The regulating cap 20 is engaged with the sprinkler gun 10 in an axially adjustable manner by way of an inner threaded section. An opening 22 is disposed at the front end of the regulating cap 20 with the regulating rod 13 in sealing engagement therewith. The regulating cap 20 can be rotated to move forward or backward axially with the help of the friction ring portion 21 having a plurality of spaced fine ditches disposed thereon so that the opening degree of the opening 22 can be varied, permitting water to be discharged in various manners. The regulating cap 20 is made of metal and is easily damaged from accidental hitting and the friction ring portion 21 is readily worn out due to use.

SUMMARY OF THE INVENTION

The primary object of the present invention is to provide an improved regulating cap having a soft guard cover secured to the front end thereof and a ring-shaped rubber friction cover to the rear end thereof so that the regulating cap will be well protected from damage due to accidental hitting and the friction cover is durable against abrasion.

Another object of the present invention is to provide an improved regulating cap equipped with an integrally formed protection cover which is readily mounted to a conventional regulating cap as a whole.

DETAILED DESCRIPTION OF THE PREFERRED EMBODIMENTS

Figure 3:
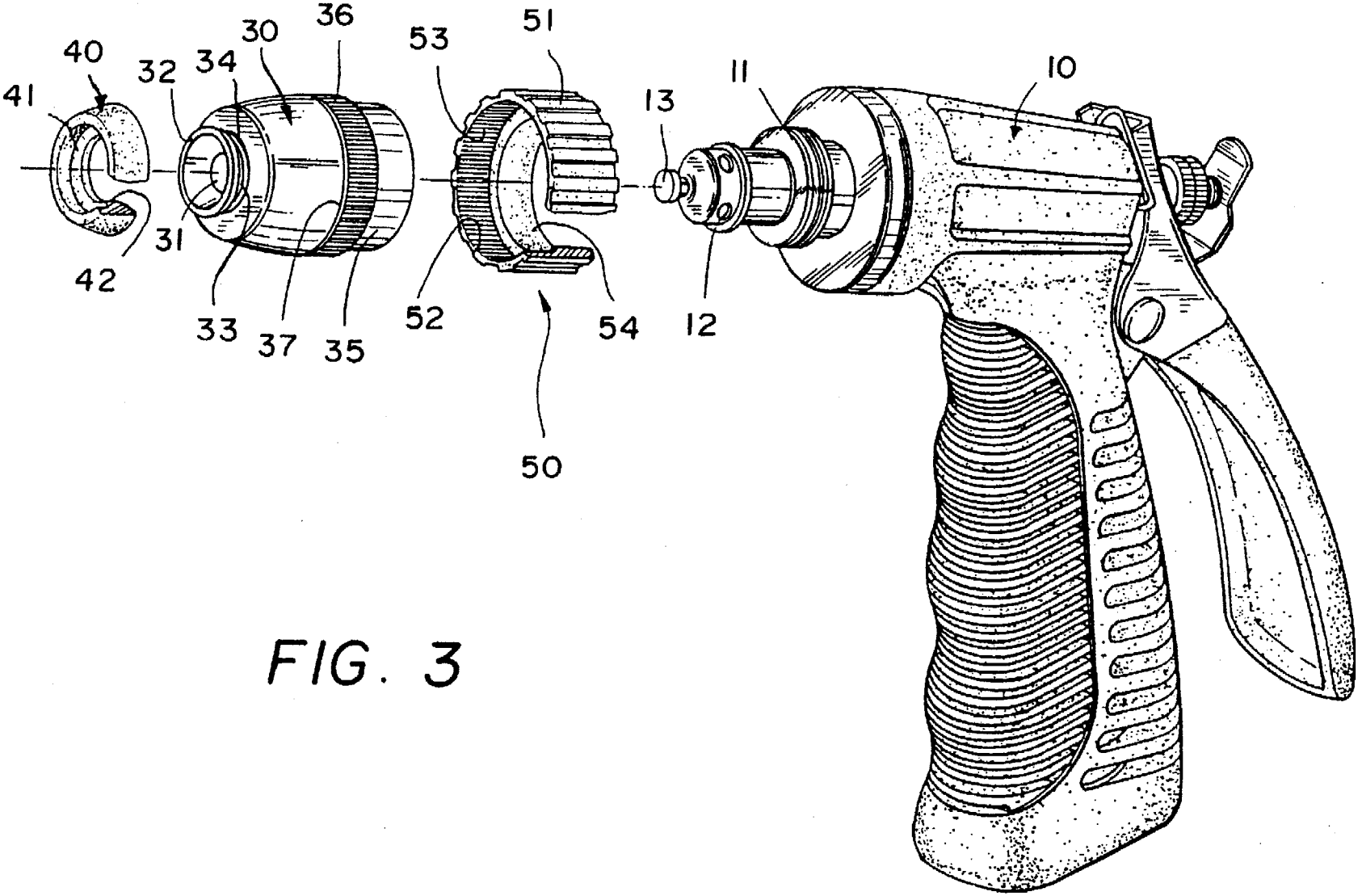
FIG. 3 is a perspective diagram showing the exploded components of protection covers of the present invention mounted to a regulating cap of a sprinkler gun.
Figure 4:
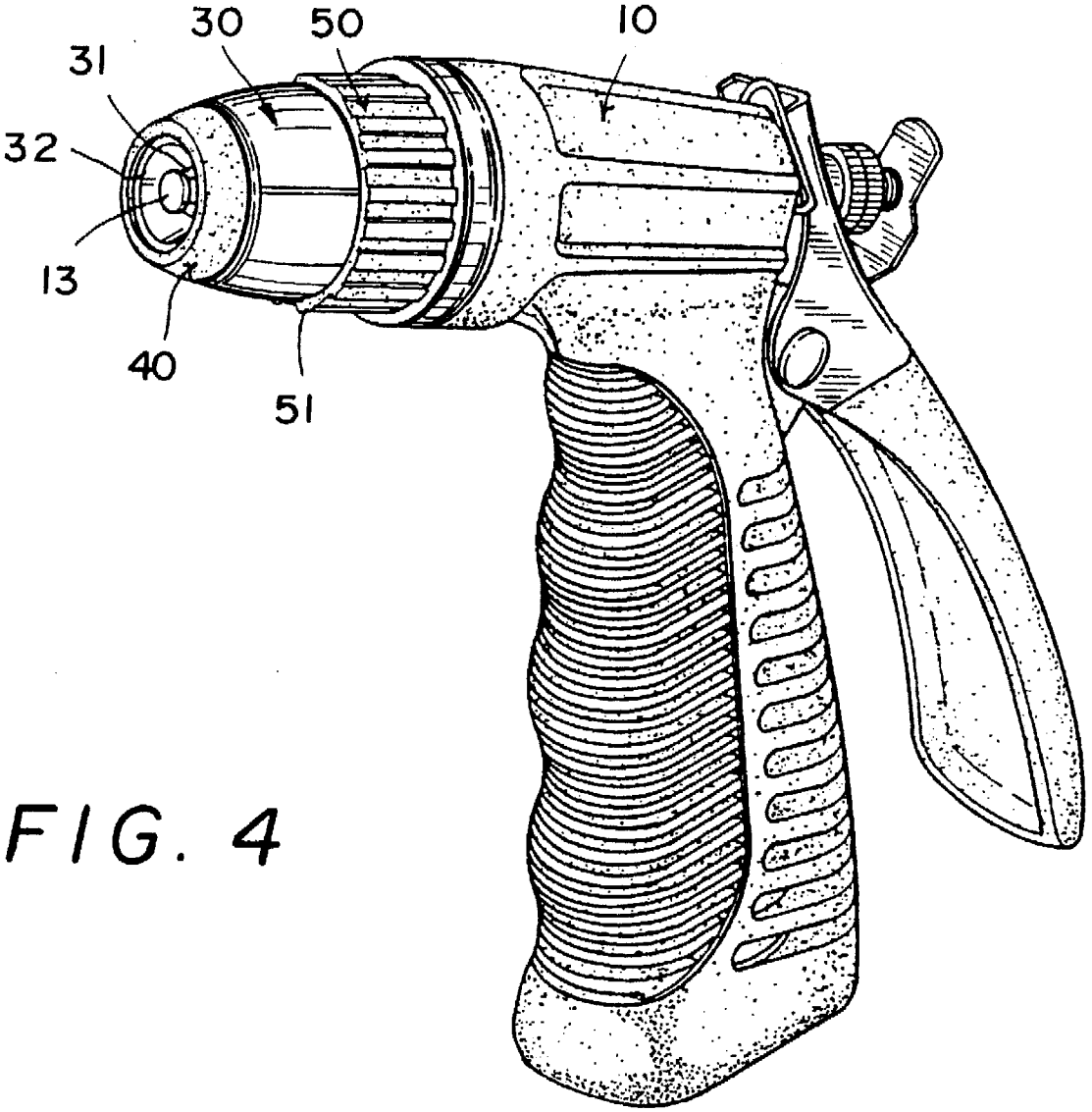
FIG. 4 is a diagram showing the regulating cap with the protection covers removably secured to a sprinkler gun.

Referring to FIG. 3, a sprinkler gun 10 has a threaded engagement section 11 at the front thereof. A number of peripherally disposed water outlet ports 12 are disposed before the engagement section 11. At the frontmost end of the sprinkler gun 10, next to the water outlet ports 12, is disposed a regulating rod 13.

A regulating cap 30 having inner threads (not shown) is engaged with the threaded engagement section 11 of the sprinkler gun 10. The regulating cap 30 has a front opening 31 which is just blocked by the regulating rod 13 when the cap is adjustably engaged with the sprinkler gun 10. By rotational adjustment of the regulating cap 30, making the same move in the axial direction, the front opening 31 blocked by the regulating rod 13 will then be opened in various degrees so that the volume of discharged water can be varied accordingly.

The regulating cap 30 is slightly in cone shape and is provided with a journalled flange section 32 at the front opening 31. The flange section 32 has a journal 33 which is disposed next to a bulged ring 34. A soft guard cover 40 having an opening and an inner circular flange 41 disposed at the middle thereof in correspondence to the journal 33 and a circular concave portion 42 in correspondence to the bulged ring 34 of the regulating cap 30 is sealedly engaged with the journalled flange section 32.

To facilitate the attachment of the guard cover 40 to the journalled flange section 32 of the regulating cap 30, the front tip of the flange section 32 is smoothly cornered. The soft guard cover 40 is slightly longer than the flange section 32 so that the opening 31 of the regulating cap 30 can be well guarded and protected from damage due to accidental hitting. So the regulating rod 13 is guarded from deformation and can move in and out smoothly.

At the rear end of the regulating cap 30 is disposed an extension 35 having a diameter smaller than its joint first ring portion 36 having a plurality of spaced fine parallel ditches. A peripheral groove 37 is disposed right next to the first ring portion 36.

A rubber friction cover 50 having a plurality of finely spaced ditches disposed on an internally defined second ring portion 53 at the front end thereof in correspondence to the first ring portion 36 of the regulating cap 30. On the outer surface of the rubber friction cover 50 are disposed a plurality of equally spaced protrusion blocks 51 so that the rubber friction cover 50 can be easily operated by fingers. A circular protrusion 54 disposed right next to the internally defined second ring portion 53 of the rubber friction cover 50 corresponds to the extension 35 of the regulating cap 30.

Figure 5:
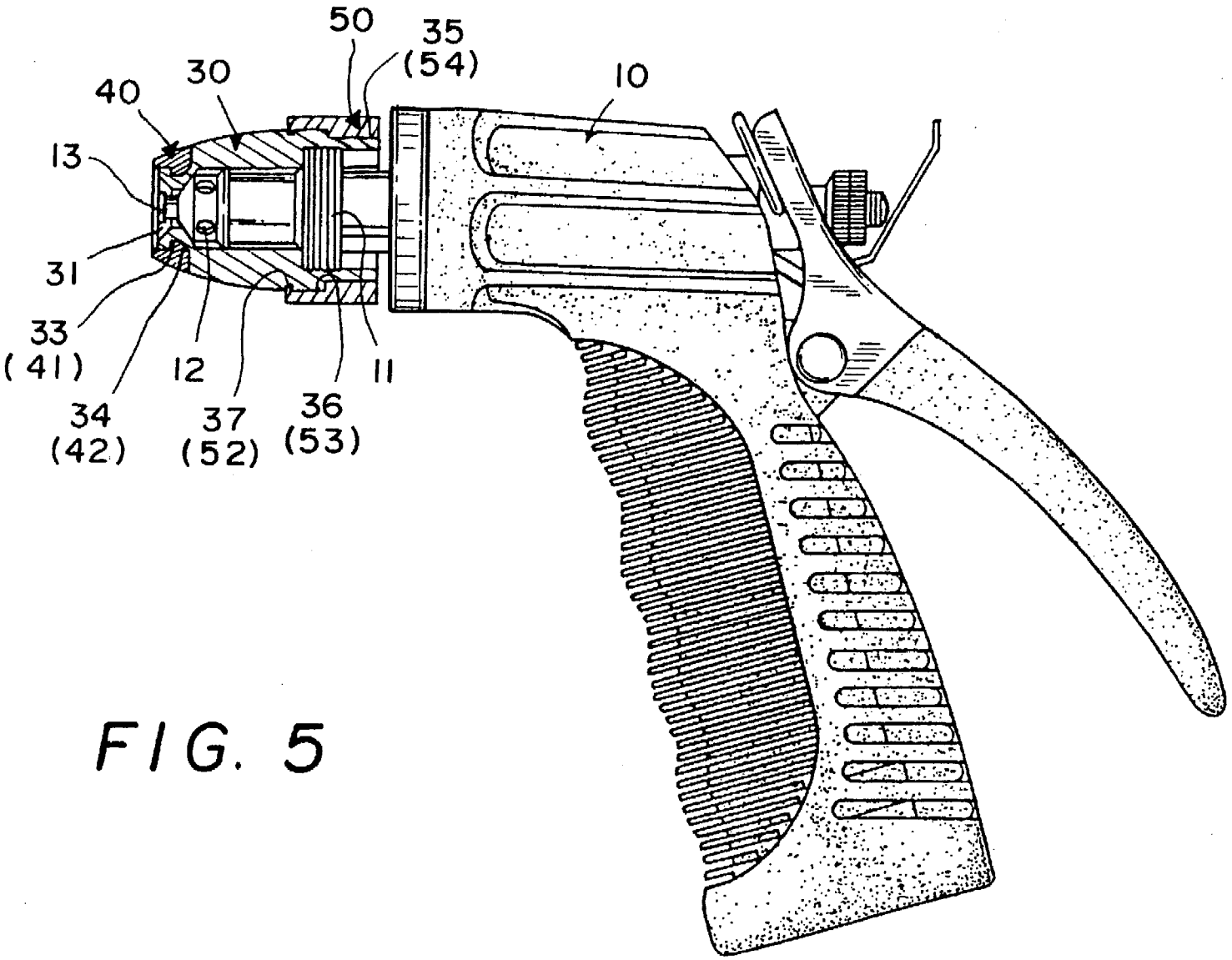
FIG. 5 shows a sectional view of a regulating cap of the present invention mounted to a sprinkler gun.

Referring to FIG. 5, the frontmost end of the rubber friction cover 50 is provided with a circular engagement protrusion 52 which is retained in the peripheral groove 37 of the regulating cap 30 in assembly. As the rubber friction cover 50 is attached to the regulating cap 30, the ditches of the first ring portion 36 are firmly engaged with those ditches of the second ring portion 53 of the rubber friction cover 50, and the circular protrusion 54 is in sealing engagement with the extension 35 of the regulating cap 30.

Figure 1:
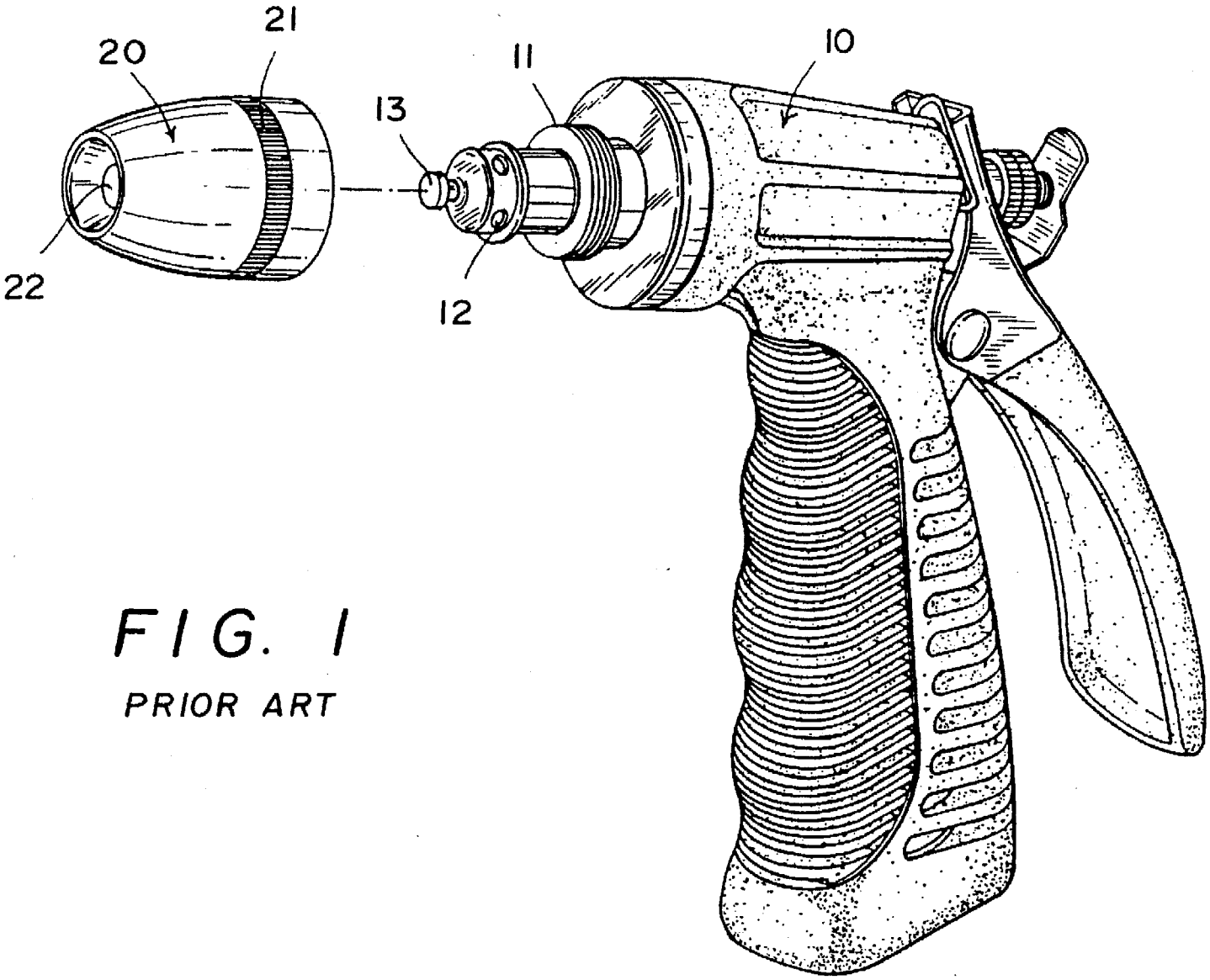
FIG. 1 PRIOR ART
FIG. 1 shows a conventional regulating cap mounted in combination to a sprinkler gun.
Figure 2:
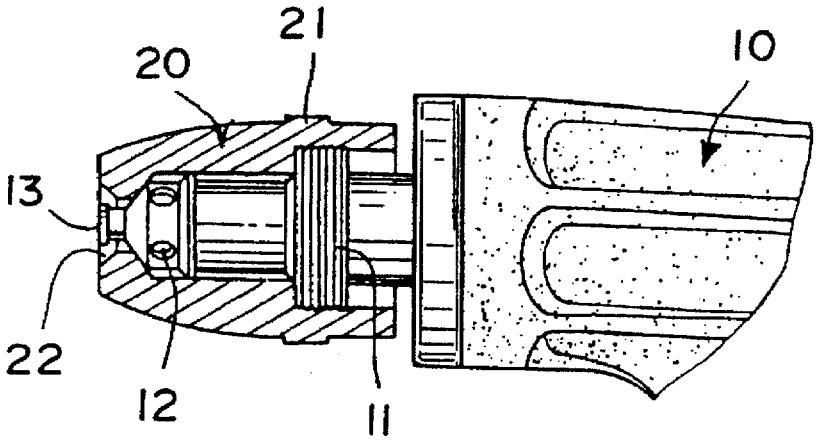
FIG. 2 PRIOR ART
FIG. 2 is a sectional view of the regulating cap shown in FIG. 1.
Figure 6:
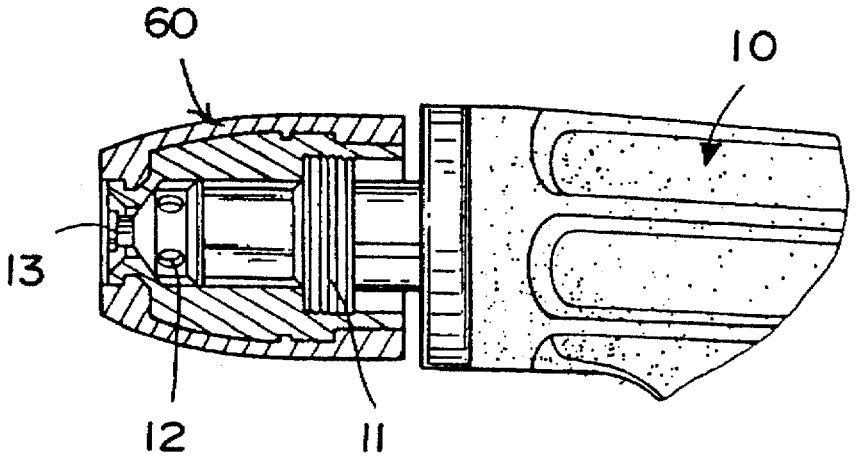
FIG. 6 is a diagram showing another embodiment of the present invention, an integrally formed protection cover secured to a regulating cap.

As shown in FIG. 6, another embodiment of the present invention is shown. A protection cover 60 is integrally formed in correspondence to the outer shape of the regulating cap 30 so as to fully protect the regulating cap 30 from damage.

I claim:

1. A water regulating cap adjustably and removably mounted on a sprinkler gun, said regulating cap having a front end and a rear end, said rear end of the said regulating cap removably attached to said sprinkler gun, a friction cover mounted about said rear end of said regulating cap, and a soft guard cover mounted about said front end of said regulating cap;

said soft guard cover including on an internal surface, an inner circular flange, and a circular concave portion disposed next to said inner circular flange;

said regulating cap including a front opening, a journalled flange section about said front opening to engage said soft guard cover, said journalled flange section having a journal engaging said inner circular flange of said soft guard cover and a bulged ring disposed next to said journal and at an end of said journalled flange section, said bulged ring engaging said circular concave portion of said soft guard cover, a peripheral groove on an external surface of said regulating cap, a first ring portion disposed next to said peripheral groove, said first ring portion having a plurality of spaced fine ditches on said external surface of said regulating cap, and an extension extending from said first ring portion;

said friction cover including a circular engagement protrusion at a frontmost tip of said friction cover, said circular engagement protrusion engaging said peripheral groove of said regulating cap, a second ring portion internal to said friction cover, said second ring portion having a plurality of spaced fine ditches and, said second ring portion sliding over and engaging said first ring portion, a circular protrusion internal to said friction cover and disposed next to said second ring portion, said circular protrusion fitting around said extension and providing a seal, and a plurality of equally spaced protrusion blocks on an external surface of said friction cover.

2. The regulating cap as defined in claim 1, wherein said soft guard cover and said friction cover are integrally formed as one piece, and said one piece is removably attached to said regulating cap.

* * * * *